United States Patent [19]

Thompson

[11] 4,003,234

[45] Jan. 18, 1977

[54] BENDING APPARATUS FOR PERFORATING STRIPS

[75] Inventor: Clyde W. Thompson, Tulsa, Okla.

[73] Assignee: Carolea Wheeler, Tulsa, Okla.

[22] Filed: May 8, 1975

[21] Appl. No.: 575,611

[52] U.S. Cl. ..... 72/141
[51] Int. Cl.[2] ..... B21D 7/024
[58] Field of Search ..... 73/217–219, 73/216, 149, 141, 145, 66

[56] References Cited

UNITED STATES PATENTS

| | | | |
|---|---|---|---|
| 25,294 | 8/1859 | Weimer | 72/145 |
| 210,873 | 12/1878 | Nichols | 72/141 |
| 280,983 | 7/1883 | Whitlock | 72/141 |
| 1,358,938 | 11/1920 | Douglemeyer | 72/141 |

*Primary Examiner*—Milton S. Mehr
*Attorney, Agent, or Firm*—William S. Dorman

[57] ABSTRACT

Apparatus for bending a thin flexible and narrow strip having a flat longitudinally extending base portion and a central longitudinally extending rib, comprising a cylinder mounted on a supporting base and having a helical recess extending from the bottom to the top thereof. The recess extends inwardly into the cylinder a distance slightly less than one-half of the width of the base portion of the strip. A rotatable arm is mounted on a shaft which extends upwardly and concentrically from the top of the cylinder. The arm has mounted thereon a slide member adapted to be moved towards and away from the cylinder. A rotatable wheel is rotatably mounted in the slide member, the wheel having an annular recess therein extending inwardly into the wheel a distance slightly less than one-half of the width of the base portion of the strip, the recess of the wheel being opposite to or in alignment with the recess on the cylinder. Means are provided on the arm for moving the member towards the cylinder so as to engage a strip between the wheel and the cylinder, the sides of the base portion of the strip being received in the recesses of the wheel and cylinder.

2 Claims, 6 Drawing Figures

BENDING APPARATUS FOR PERFORATING STRIPS

BACKGROUND OF THE INVENTION

1. Field of the Invention

The present invention relates to an apparatus for bending a thin flexible and narrow strip. More particularly, the present invention relates to an apparatus for bending a thin flexible and narrow strip of the type used for perforating or shearing paper sheets being printed wherein the strip is bent into a predetermined curved or circular shape.

2. The Prior Art

The present invention relates to bending of thin flexible and narrow strips of the type shown in Bashaw U.S. Pat. No. 3,035,342 and, in particular, to the bending of the strip such as shown in FIG. 9 of the Bashaw patent. As also indicated in the Bashaw patent, there is a demand in the printing industry for extremely thin and flexible strip having a series of upstanding teeth, or a continuous tooth or rib, extending along a longitudinal line on one face thereof, the opposite face being flat. Such a strip is employed for perforating or shearing the paper sheets being printed, and must be sufficiently flexible to permit its being bent around the cylinder of an off-set press, and secured thereto by means of a suitable adhesive. In the past, these strips are generally placed on the cylinder of the off-set press so as to provide essentially linear perforated or shear lines on the paper sheets.

Prior to the present invention, the industry has recognized the desire to bend a strip into predetermined curved or circular shapes so that circles or tear-drops, for example, can be sheared or perforated into the paper strips; however, since the rib or tooth portion must still be at right angles to the paper sheets, the bending of the flexible strip will have to be at right angles to the base portion of the strip. Efforts to bend the strip into predetermined geometric shapes have been, largely, unsuccessful.

SUMMARY OF THE INVENTION

The present invention involves an apparatus for bending a thin flexible and narrow strip having a flat longitudinally extending base portion and a central longitudinally extending rib projecting upwardly from the base portion at right angles thereto, the upper edge of the rib being sharpened, the strip being of the type adapted to be attached to a printing cylinder and used for perforating or shearing paper sheets being printed. The apparatus which is designed to bend the strip at right angles to the base portion thereof to form curved geometric shapes, such as a circle, for cutting circular openings in the paper sheets comprises a vertical cylinder mounted on a supporting base, the cylinder having a helical recess extending for a substantial length of the cylinder, preferably from the bottom to the top thereof. The recess extends inwardly into the cylinder a distance slightly less than one-half of the width of the base portion of the strip. A threaded shaft extends upwardly and concentrically from the top of the cylinder. The threads on the threaded shaft are exactly of the same pitch as the helical recess on the cylinder. A horizontal and rotatable arm is mounted so that a threaded portion thereof threadedly engages the threaded shaft. A slide member is mounted on the arm and is adapted to be moved towards and away from the cylinder. A rotatable wheel is rotatably mounted on the slide member on the side thereof towards the cylinder, the wheel having an annular recess therein extending inwardly into the wheel a distance slightly less than one-half of the width of the base portion of the strip, the recess of the wheel being opposite to, or in alignment with, the recess on the cylinder. Means are provided on the arm for moving the slide member towards the cylinder so as to engage a strip which is positioned between the wheel and the cylinder, the sides of the base portion of the strip being received in the recesses of the wheel and cylinder. When the arm is rotated in a direction to move the same upwardly along the threaded shaft, the wheel will bend the strip around the cylinder in the helical recess. Because the threads on the threaded shaft are of the same pitch as the helical recess in the cylinder, the recess in the wheel will at all times track with the helical recess in the cylinder.

DESCRIPTION OF THE PREFERRED EMBODIMENTS

Figure 1:
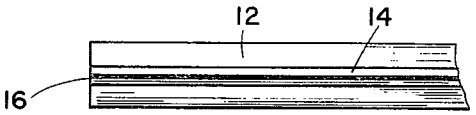
FIG. 1 is a plan view of a portion of a strip which is bent by the apparatus of the present invention.
Figure 2:
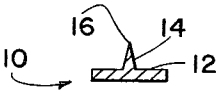
FIG. 2 is a cross-sectional view of the strip shown in FIG. 1 and is also a cross-sectional view taken along section line 2–2 of FIG. 3.
Figure 3:
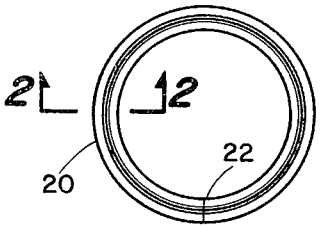
FIG. 3 is a plan view of a strip, such as that shown in FIG. 1, after it has been bent into a circular shape by the apparatus of the present invention.

Referring to the drawings in detail, FIG. 1 shows a strip 10 generally similar to that shown in FIG. 9 of Bashaw U.S. Pat. No. 3,035,342. This strip includes a flat base portion 12 and a central rib or continuous tooth 14 having an upper sharpened edge 16. FIG. 3 shows the strip of FIG. 1 after it has been bent into the shape provided by the apparatus of the present invention; thus, this figure shows a circular shape 20 where the end portions mate together at 22. When the circular member 20 of FIG. 3 is placed on the cylinder of an off-set press, the upper sharpened edges 16 will provide a substantially circular cut on the sheets of paper passing through the press.

Figure 4:
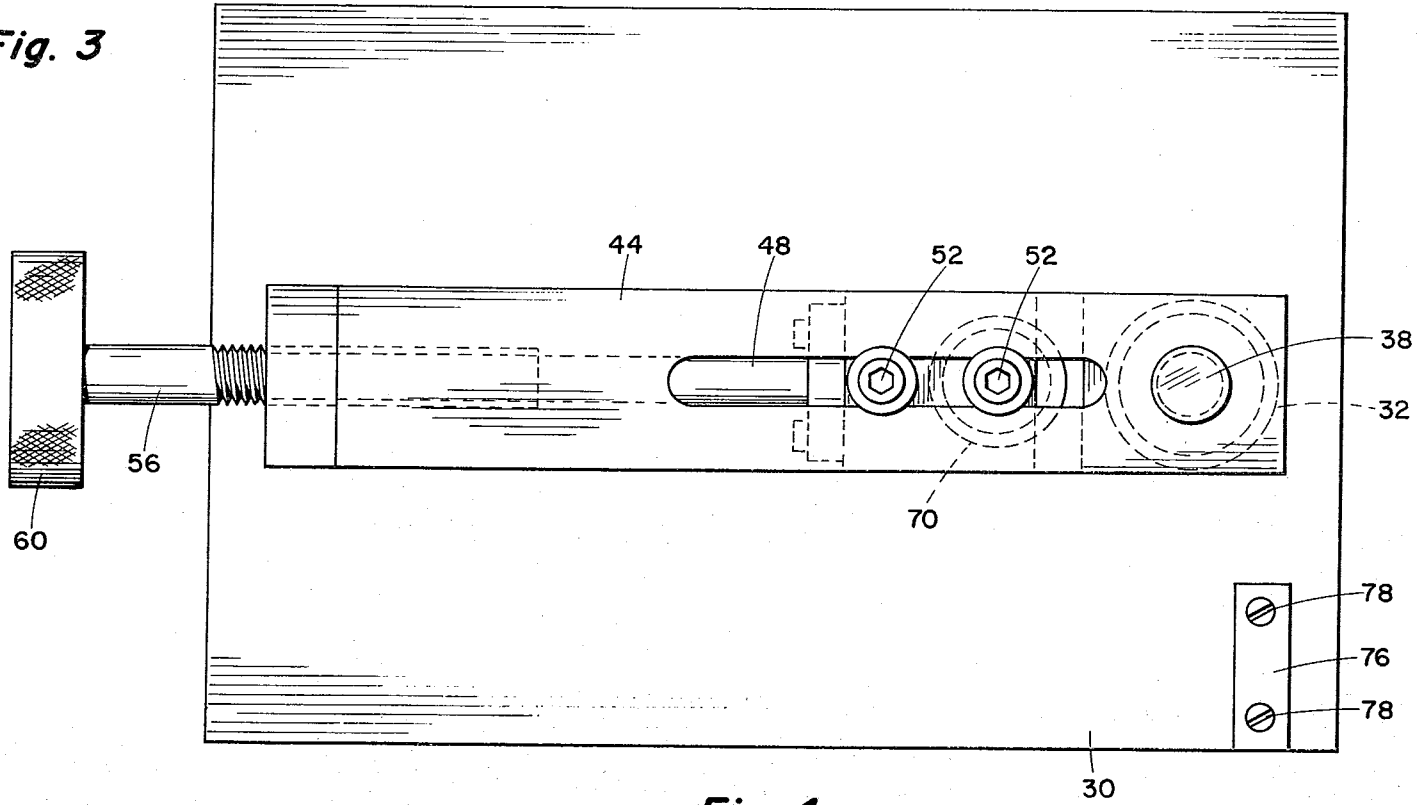
FIG. 4 is a plan view of the bending apparatus of the present invention.
Figure 5:
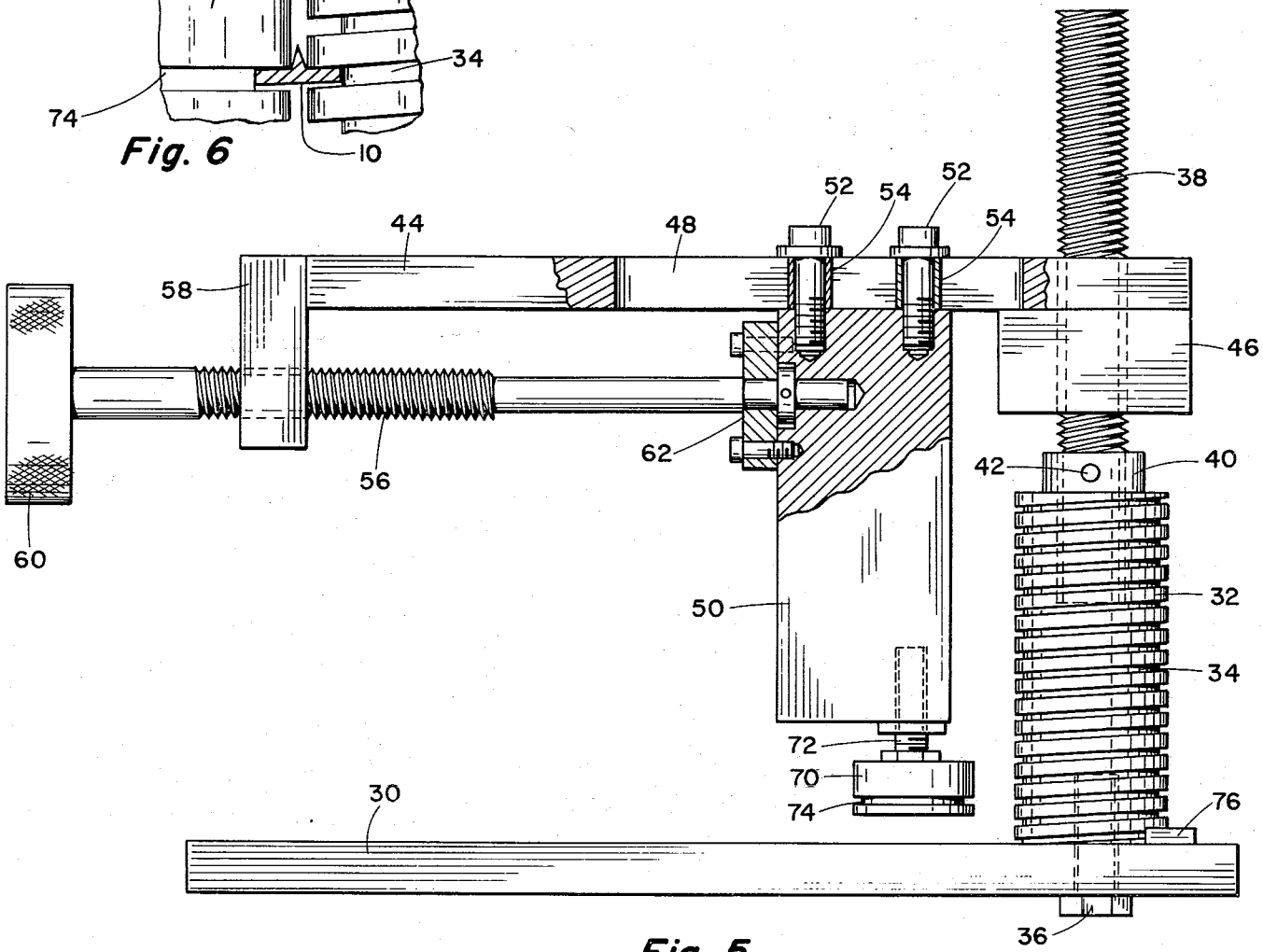
FIG. 5 is a side elevation of the bending apparatus shown in FIG. 4, with certain parts being broken away for the sake of illustration.
Figure 6:
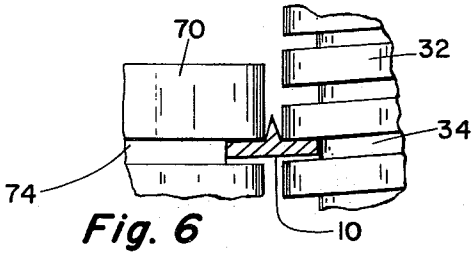
FIG. 6 is a fragmentary view, on a slightly enlarged scale, of a portion of the wheel and a portion of the cylinder and with an engaged strip shown in cross-section.

Referring now to FIGS. 4 and 5, the apparatus of the present invention includes base member 30 to which a cylinder 32 is attached by means of a screw 36 or any other convenient means. The cylinder 32 is provided with a helical recess 34 which extends into the cylinder a distance slightly less than one-half of the width of the base portion 12 of the strip 10. A threaded shaft 38 is mounted concentrically above the cylinder 32. The lower end of the shaft 38 extends into an opening in the cylinder 32 and is held in fixed position with respect thereto by means of a collar 40 and a set screw 42.

A rotatable arm 44 is mounted above the cylinder 32 in such a manner that a threaded portion 46 of the arm 44 threadedly engages the threads of the threaded shaft 38. The arm 44 is provided with a longitudinally extending slot 48 in which is mounted a slide member 50. The upper end of the slide member 50 is received within the slot 48 by means of screws 52 which are threadedly received in suitable openings at the upper end of the slide member 50. Each screw 52 has received thereon a bushing 54 which has an outer diameter substantially equal to the width of the slot 48. Since the heads on the screws 52 are larger than the width of the slot 48, the slide 50 is properly held in the slot 48 for sliding movement towards and away from the cylinder 32. A threaded rod 56 threadedly engages a forwardly and downwardly directed portion 58 on the arm 44. The outer end of the threaded rod 56 is provided with a knob 60 which permits the turning of the rod. The right-hand end of the threaded rod 56 (see FIG. 5) engages a suitable thrust bearing 62 which is secured to the slide 50 in any conventional manner. A wheel 70 is rotatably mounted on a shaft 72 connected to the bottom of the slide 50. The wheel 70 is provided with an annular recess 74 which extends into the wheel a distance slightly less than one-half of the width of the base portion of the strip. As will hereinafter appear, it is desired that the recess 74 always be in opposition to the helical recess 34. Therefore, it should be understood that the shaft 72 is adjustable so as to move the wheel slightly upwardly or slightly downwardly to insure proper alignment between the recess 74 and the recess 34.

A clamp 76 is connected to the base 30 by means of screws 78.

OPERATION

When it is desired to make a curved or circular shape by bending a strip 10, the apparatus shown in FIG. 5 is adjusted by turning the arm 44 in a clockwise direction, for example, until the recess 74 is opposite the lower right-hand portion of the helical recess 34. At this time, a strip 10 of sufficient length, depending upon how many convolutions it is desired to bend around the cylinder 32, is positioned so that one end is clamped under the clamp 76. The screws 78 on the clamp 76 are loosened and the end is inserted under the clamp and the screws 78 are tightened thereafter. One side of the base portion 12 of the strip 10 should, at that time, be positioned in the lower convolution of the recess 34. At this time, the knob 60 is turned so that the slide 50 moves towards the cylinder 32. Turning of the threaded rod 56 continues until the other side of the base portion of the strip 10 is received within the recess 74 of the wheel 70.

With the strip 10 now firmly engaged between the wheel 70 and the cylinder 32, the arm 44 can now be rotated, for example in a counter-clockwise direction so as to bend the strip 10 around the cylinder 32. As the strip 10 is bent around the 32, it progresses upwardly in the helical groove 34; at the same time, since the pitch of the threads on the threaded shaft 38 is the same as the pitch of the helical groove 34, the groove 74 will "track" or at all times be in opposition to the adjacent portion of the groove 34.

After the desired number of convolutions of the strip 10 have been bent around the cylinder 32, the slide 50 is moved away from the cylinder 32, the clamp 76 is released, and the resulting spiral strip can now be cut into a plurality of circular segments. The slight helix angle of each strip can be easily removed by hand so that the ends of each circular segment will abutt as at 22. Because the strip 10 has a tendency to spring back, the resulting circles produced by the apparatus of the present invention will be slightly larger in diameter than that of the cylinder 32.

If it is desired to create a tear-drop effect, a strip 10 can be bent through slightly less than one full revolution or convolution and the overlapping straight ends can be cut to provide a point, the overall shape being that of a tear-drop.

Whereas the present invention has been described in particular relation to the drawings attached hereto, it should be understood that other and further modifications, apart from those shown or suggested herein, may be made within the spirit and scope of this application.

What is claimed is:

1. Apparatus for bending a thin flexible and narrow strip having a flat longitudinally extending base portion and a central longitudinally extending rib projecting upwardly from the base portion at right angles thereto, the upper edge of said rib being sharpened, said strip being of the type adapted to be attached to a printing cylinder and used for perforating or shearing paper sheets being printed, said apparatus being adapted to bend said strip at right angles to the base portion thereof to form a substantially rounded shape for cutting rounded openings in said paper sheets; comprising a vertical cylinder mounted on a supporting means; said cylinder having a helically extending recess therein of a predetermined pitch, said recess extending inwardly into said cylinder a distance slightly less than one-half of the width of the base portion of said strip; a threaded shaft extending coaxially upwardly from said cylinder and having threads thereon of the same pitch as the recess of said cylinder; a horizontal arm rotatably mounted above said cylinder, said arm having a threaded portion threadedly engaging the threads of said threaded shaft; said arm having mounted thereon a slide member adapted to be moved towards and away from said cylinder, a rotatable wheel rotatably mounted in said slide member on the side thereof towards said cylinder, said wheel having an annular recess therein extending inwardly into the wheel a distance slightly less than one-half of the width of the base portion of said strip, the recess in said wheel being in alignment with the recess in said cylinder, means mounted on said arm for moving said slide member towards said cylinder so as to engage said wheel with a strip positioned between said wheel and said cylinder, the sides of the base portion of said strip being received in the opposed recesses in said wheel and said cylinder, whereby, when said arm is rotated, said strip will be bent around said cylinder in the helical recess thereof while the recess in said wheel remains in alignment with the recess in said cylinder.

2. Apparatus for bending a thin flexible and narrow strip as set forth in claim 1 including means mounted on said base portion for clamping one end of said strip thereto.

* * * * *